US009004962B1

(12) United States Patent
Pelini

(10) Patent No.: US 9,004,962 B1
(45) Date of Patent: Apr. 14, 2015

(54) TILT AND LIFT JACK PLATE

(71) Applicant: Mark F. Pelini, Valrico, FL (US)

(72) Inventor: Mark F. Pelini, Valrico, FL (US)

( * ) Notice: Subject to any disclaimer, the term of this patent is extended or adjusted under 35 U.S.C. 154(b) by 147 days.

(21) Appl. No.: 13/866,067

(22) Filed: Apr. 19, 2013

(51) Int. Cl.
*B63H 20/08* (2006.01)
*B63H 20/10* (2006.01)

(52) U.S. Cl.
CPC ..... *B63H 20/10* (2013.01)

(58) Field of Classification Search
CPC ..... B63H 20/16
USPC ..... 440/53, 49, 61 T, 61 D, 61 E; 114/284, 114/285
See application file for complete search history.

(56) References Cited

U.S. PATENT DOCUMENTS

| | | | | |
|---|---|---|---|---|
| 2,833,312 | A | 5/1958 | Flick | |
| 3,242,899 | A | 3/1966 | Hanson | |
| 4,624,438 | A | 11/1986 | Goodman | |
| 4,950,189 | A | 8/1990 | Tahara | |
| 5,100,349 | A | 3/1992 | Perkins | |
| 5,117,741 | A | 6/1992 | Richards | |
| 5,704,308 | A | 1/1998 | Anderson | |
| 5,782,662 | A | 7/1998 | Icenogle | |
| 6,126,498 | A | 10/2000 | Icenogle | |
| 6,305,996 | B1 * | 10/2001 | Detwiler | 440/53 |
| 6,890,227 | B1 | 5/2005 | Alby | |
| 7,527,539 | B1 | 5/2009 | Pelini | |
| 7,731,552 | B1 | 6/2010 | Pelini | |
| D622,287 | S | 8/2010 | Pelini | |
| 8,210,886 | B1 | 7/2012 | Pelini | |
| 2007/0221113 | A1 * | 9/2007 | Detwiler et al. | 114/285 |

* cited by examiner

*Primary Examiner* — S. Joseph Morano
*Assistant Examiner* — Anthony Wiest
(74) *Attorney, Agent, or Firm* — Edward P. Dutkiewicz

(57) ABSTRACT

A tilt and lift jack plate comprising several components, in combination. There is a pair of transom mounting brackets and a pair of slide plate holders. A slide plate is slidably coupled to each of the slide plate holders. A tilting hydraulic cylinder ram mounting bracket is coupled to the slide plate. A lifting hydraulic cylinder ram bracket is coupled to the slide plate.
The cylinders are coupled to a hydraulic pump and control valve.

13 Claims, 4 Drawing Sheets

FIG. 3
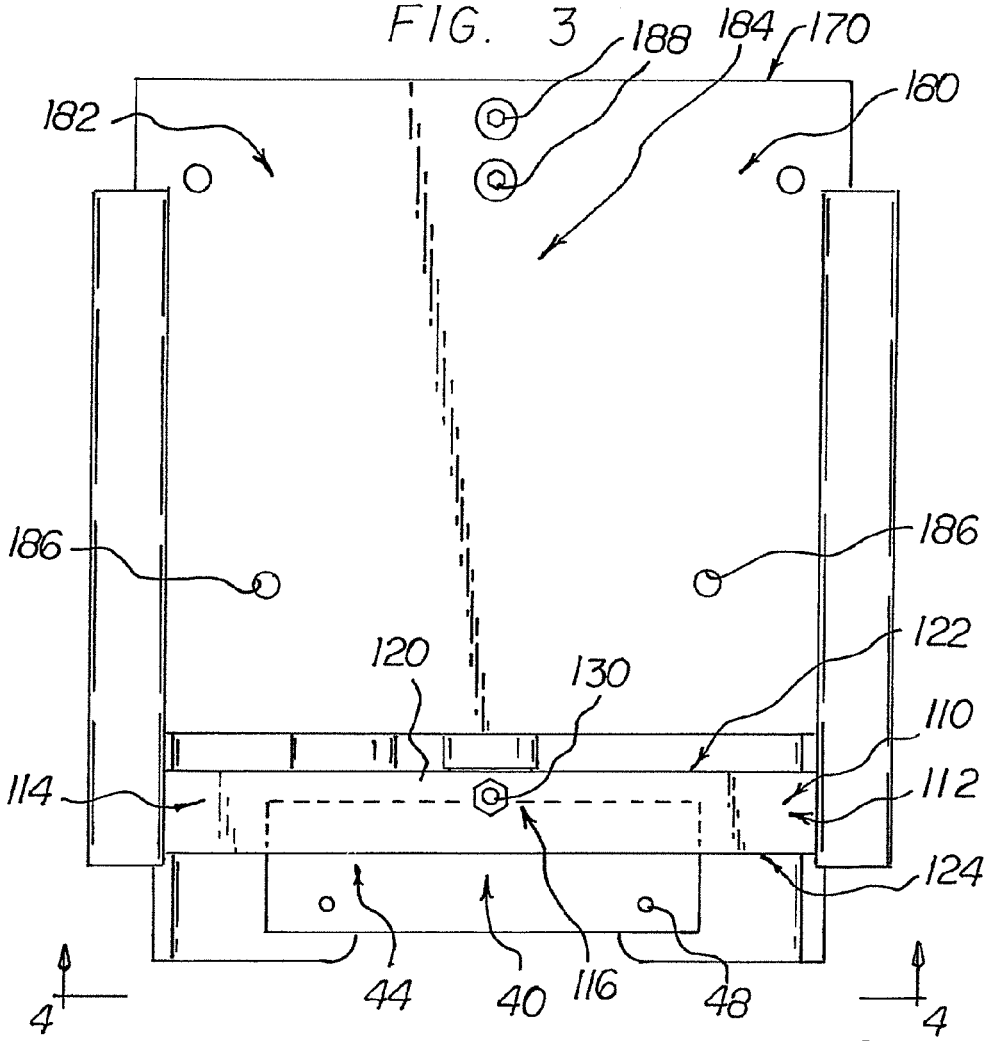
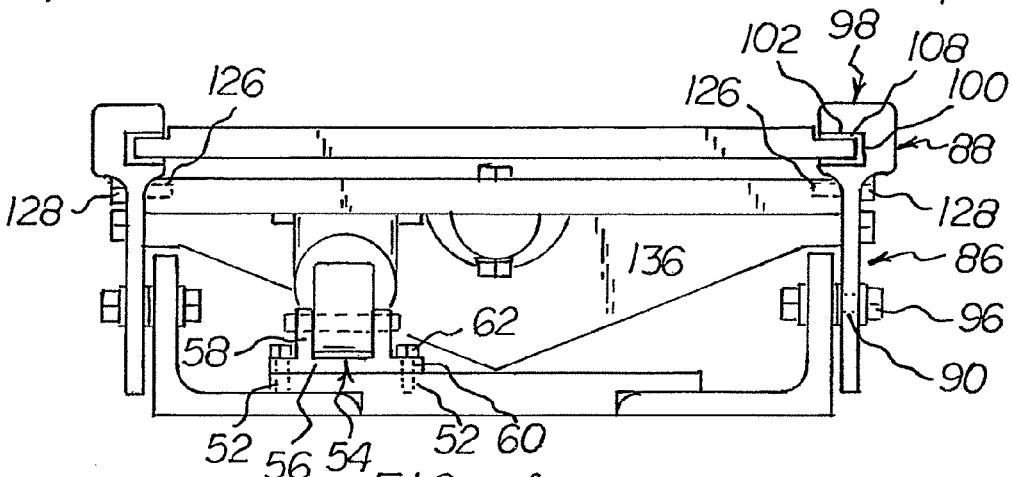
FIG. 4

TILT AND LIFT JACK PLATE

RULE 1.78(F) (1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a tilt and lift jack plate and more particularly pertains to a jack plate which has both tilt and lift capabilities.

2. Description of the Prior Art

The use of devices to raise an outboard motor on a boat is known in the prior art. More specifically, devices to raise an outboard motor on a boat previously devised and utilized for the purpose of adjusting the height of a motor to meet specific requirements are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe tilt and lift jack plate that allows a user to adjust the jack plate with both tilt and lift capabilities.

In this respect, the tilt and lift jack plate according to the present invention substantially departs from the conventional concepts and designs of the prior art, and in doing so provides an apparatus primarily developed for the purpose providing a jack plate which has both tilt and lift capabilities.

Therefore, it can be appreciated that there exists a continuing need for a new and improved tilt and lift jack plate which can be used for positioning an outboard motor as to both tilt and lift by use of a single jack plate, having both tilt and lift capabilities. In this regard, the present invention substantially fulfills this need.

SUMMARY OF THE INVENTION

In view of the foregoing disadvantages inherent in the known types of devices to raise an outboard motor on a boat now present in the prior art, the present invention provides an improved tilt and lift jack plate. As such, the general purpose of the present invention, which will be described subsequently in greater detail, is to provide a new and improved tilt and lift jack plate which has all the advantages of the prior art and none of the disadvantages.

To attain this, the present invention essentially comprises a tilt and lift jack plate, comprising several components, in combination.

First, there is a pair of mirror image transom mounting brackets, being a right transom mounting bracket and a left transom mounting bracket. Each transom mounting bracket has an upper end and a lower end. Each transom mounting bracket has a forward leg configured to be attached to a boat transom, and a rearward directed leg. The forward leg and the rearward leg each are oriented at right angles to each other. The forward leg has a first length, and the rearward leg has a second length. The first length is greater than the second length. The forward leg has a thickness, with a forward surface and a rearward surface. The forward leg has a plurality of transom mounting bolt apertures there through. Each forward leg, of the transom mounting bracket, has a lower cross member mounting bolt hole therethrough. Each rearward leg of each transom mounting bracket has a pivot point aperture located near the upper end of each transom mounting bracket.

Next, there is a lower transom mounting bracket cross member. The lower transom mounting bracket cross member has a generally rectilinear configuration, with a right end portion and a left end portion. The right end portion and the left end portion each have a stepped configuration, forming a recess therein.

Each lower transom mounting bracket cross member recess has a lower transom mounting bracket cross member threaded bolt hole therein. Each lower transom mounting bracket cross member threaded bolt hole has an associated lower transom mounting bracket cross member bolt.

The lower transom mounting bracket cross member bolt is used to couple the lower transom mounting bracket cross member with each of the forward legs of the transom mounting brackets. The left end portion of the lower transom mounting bracket cross member has a pair of threaded tilting hydraulic cylinder case bracket mounting bolt holes therein.

In describing this invention, the words, "couple" and the variation, "coupled", are used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another. The phrase "continuous with" means that the portion, or part, referred to continues from another part, such as the item being made from a single billet or piece of material.

Next, there is a tilting hydraulic cylinder case bracket. The tilting hydraulic cylinder case bracket has a lower transom cross member portion, and a pair of rearwardly oriented tabs. The lower transom cross member portion has a pair of mounting bolt holes therethrough, with a pair of associated tilting hydraulic cylinder case bracket mounting bolts, for coupling the tilting hydraulic cylinder case bracket to the lower transom mounting bracket cross member.

Next there is a pair of slide plate holders being a right slide plate holder and a left slide plate holder. The slide plate holders each are mirror images of the other. Each slide plate holder has an upper end, a lower end, a forward surface, a rearward surface, an outward surface, and an inward surface. Each slide plate holder has a forward portion. Each slide plate holder has a rearward portion. The forward portion of each slide plate holder has a generally rectilinear configuration, with each slide plate holder forward portion having a pivot point bolt hole therethrough.

The forward portion of each slide plate holder has a pair of upper slide plate holder cross member mounting bolt holes therethrough. The forward portion of each slide plate holder has a slide plate holder lower cross member mounting bolt hole therethrough. The forward portion of each slide plate holder has an associated pivot point bolt, with the pivot point bolt rotatably coupling the forward portion of each slide plate holder to the transom mounting bracket.

The rearward portion of each slide plate holder has a generally C-shaped configuration, with a slide plate groove being located in the inward surface of each rearward portion of each slide plate holder. The rearward portion of each slide plate holder has a threaded grease fitting aperture, with a grease fitting threadly coupled thereto. Each grease fitting aperture is in communication with the slide plate groove. Each slide plate holder rearward portion groove has a groove insert located therein.

Next, there is a slide plate holder lower cross member. The slide plate holder lower cross member has a generally rectilinear configuration, with a right end, a left end, and a central portion. The slide plate holder lower cross member also has a forward surface, a rearward surface, a top surface, and a bottom surface. The right end of the slide plate holder lower cross member and the left end of the slide plate holder lower cross member each have a threaded aperture therein. The slide plate holder lower cross member having an associated bolt, with the associated bolt of the slide plate holder lower cross member fixedly coupling each slide plate holder to each other slide plate holder by the bolt passing through the slide plate holder lower cross member mounting bolt hole and into the threads of the threaded aperture of the slide plate holder lower cross member. The central portion of the slide plate holder lower cross member has a lifting hydraulic ram mounting bolt hole there through.

Next, there is an upper slide plate holder cross member having an upper surface, a lower surface, a right end, and a left end with a center, therebetween. The upper slide plate holder cross member also has a forward surface and a rearward surface. The upper slide plate cross member forward surface has a generally V-shaped configuration. The upper slide plate cross member rearward surface is a generally flat surface, with a hemispherical recess therein. The hemispherical recess is centrally located on the rearward surface of the upper slide plate cross member. The upper slide plate cross member right end and the upper slide plate cross member left end each have a pair of threaded bolt holes therein. The upper slide plate cross member threaded bolt holes each have an associated bolt. The upper slide plate cross member bolt fixedly couples the upper slide plate cross member to the right slide plate holder and to the left slide plate holder. The lower surface of the upper slide plate holder cross member has a pair of threaded tilting hydraulic cylinder ram mounting bracket bolt holes located to one side of the center of the upper slide plate holder cross member.

Next, there is a tilting hydraulic cylinder ram mounting bracket having an upper slide plate holder cross member portion and a pair of downwardly oriented tabs. The upper slide plate holder cross member portion of the tilting hydraulic cylinder ram mounting bracket having a pair of mounting bolt holes there through. There is a pair of associated tilting hydraulic cylinder ram bracket mounting bolts, for coupling the tilting hydraulic cylinder ram bracket to the lower surface of the upper slide plate holder cross member.

Next, there is a slide plate. The slide plate has a generally rectilinear configuration, with a rearward surface and a forward surface. The slide plate also has an upper surface, a lower surface, a right side portion and a left side portion. The slide plate as a central portion which is between the left side portion of the slide plate and the right side portion of the slide plate.

The slide plate has a plurality of motor mounting bolt holes therethrough. The slide plate has a pair of lifting ram bracket mounting bolt holes therethrough. The lifting ram bracket mounting bolt holes are generally centrally located near the upper surface of the slide plate. By generally centrally located is meant that the holes are located generally between the right side portion and the left side portion, in the central portion of the slide plate.

Next, there is a lifting hydraulic cylinder ram bracket. The lifting hydraulic cylinder ram bracket has a generally C-shaped configuration. The lifting hydraulic cylinder ram bracket has a rearward mounting portion and a pair of forward oriented tabs. The rearward mounting portion of the lifting ram bracket has a pair of rearward mounting portion bolt holes therethrough. The rearward mounting bolt holes have a pair of associated rearward mounting portion bolts. The rearward mounting portion bolts are used to fixedly couple the lifting ram bracket to the central portion of the slide plate. The forward oriented tabs of the lifting ram bracket each have a lifting hydraulic ram pin hole therethrough.

Next, there is a lifting hydraulic cylinder having a lifting hydraulic ram and a lower case. The lower case of the lifting hydraulic cylinder is fixedly coupled to the slide plate holder lower cross member. The lower case of the lifting hydraulic cylinder has a plurality of fluid passageways therethrough. The lifting hydraulic cylinder ram has a distal end. The distal end of the lifting hydraulic cylinder ram has a pin hole therethrough. There is an associated lifting hydraulic cylinder ram pin. The lifting hydraulic cylinder ram pin rotatably couples the lifting hydraulic ram with the lifting hydraulic cylinder ram bracket. The lifting hydraulic cylinder ram pin passes through the forward oriented tabs of the lifting ram bracket and through the lifting hydraulic cylinder ram pin hole.

Next, there is a tilting hydraulic cylinder. The tilting hydraulic cylinder has a tilting hydraulic ram and a lower case. The lower case of the tilting hydraulic cylinder being fixedly coupled to the tilting hydraulic cylinder case bracket of the lower transom mounting bracket cross member.

The lower case of the tilting hydraulic cylinder has a plurality of fluid passageways therethrough. The tilting hydraulic cylinder ram has a distal end. The distal end of the tilting hydraulic cylinder ram has a pin hole therethrough. The tilting hydraulic cylinder has an associated ram pin. The tilting hydraulic cylinder ram pin rotatably couples the tilting hydraulic ram with the tilting hydraulic cylinder ram mounting bracket.

Next, there is a plurality of hydraulic fluid lines. The hydraulic fluid lines are operatively coupled to each of the fluid passageways of the tilting hydraulic cylinder and the lifting hydraulic cylinder.

Next, there is a hydraulic pump having a reservoir of hydraulic fluid.

Next, there is a control valve body. The control valve body is coupled to the hydraulic pump, the lifting hydraulic cylinder, and the tilting hydraulic cylinder. The control valve body controls the hydraulic fluid flow to the lifting hydraulic cylinder and the tilting hydraulic cylinder. The control valve body has an actuator means.

Lastly, there is a power source. The power source use used to provide power to the hydraulic pump. The power source is operatively coupled to the hydraulic pump.

The hydraulic fluid lines couple the hydraulic pump to the control valve and the control valve to the lifting hydraulic cylinder and the tilting hydraulic cylinder. This configuration allows the fluid to move from the reservoir, through the pump, through the control valve, to the hydraulic cylinders, and back through the control valve, and back to the reservoir.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tilt and lift jack plate which has all of the advantages of the prior art devices to raise an outboard motor, and adjust the angle of the motor relative to the transom, on a boat, with none of the disadvantages.

It is another object of the present invention to provide a new and improved tilt and lift jack plate which may be easily and efficiently manufactured and marketed.

It is further object of the present invention to provide a new and improved tilt and lift jack plate which is of durable and reliable constructions.

An even further object of the present invention is to provide a new and improved tilt and lift jack plate which is susceptible of a low cost of manufacture with regard to both materials and labor, and which accordingly is then susceptible of low prices of sale to the consuming public, thereby making such tilt and lift jack plate economically available to the buying public.

Even still another object of the present invention is to provide a tilt and lift jack plate to allow a user to adjust motor height and motor angle, relative to a transom, by providing a jack plate having both tilt and lift capabilities.

Lastly, it is an object of the present invention to provide a new and improved tilt and lift jack plate comprising several components, in combination. There is a pair of transom mounting brackets and a pair of slide plate holders. A slide plate is slidably coupled to each of the slide plate holders. A tilting hydraulic cylinder ram mounting bracket is coupled to the slide plate. A lifting hydraulic cylinder ram bracket is coupled to the slide plate.

The cylinders are coupled to a hydraulic pump and control valve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an elevational view from the rear of the jack plate, where the jack plate attaches to an outboard motor.

FIG. 4 is a view taken along line 4-4 of FIG. 3.

The same reference numerals refer to the same parts throughout the various Figures.

DESCRIPTION OF THE PREFERRED EMBODIMENT

Figure 1:
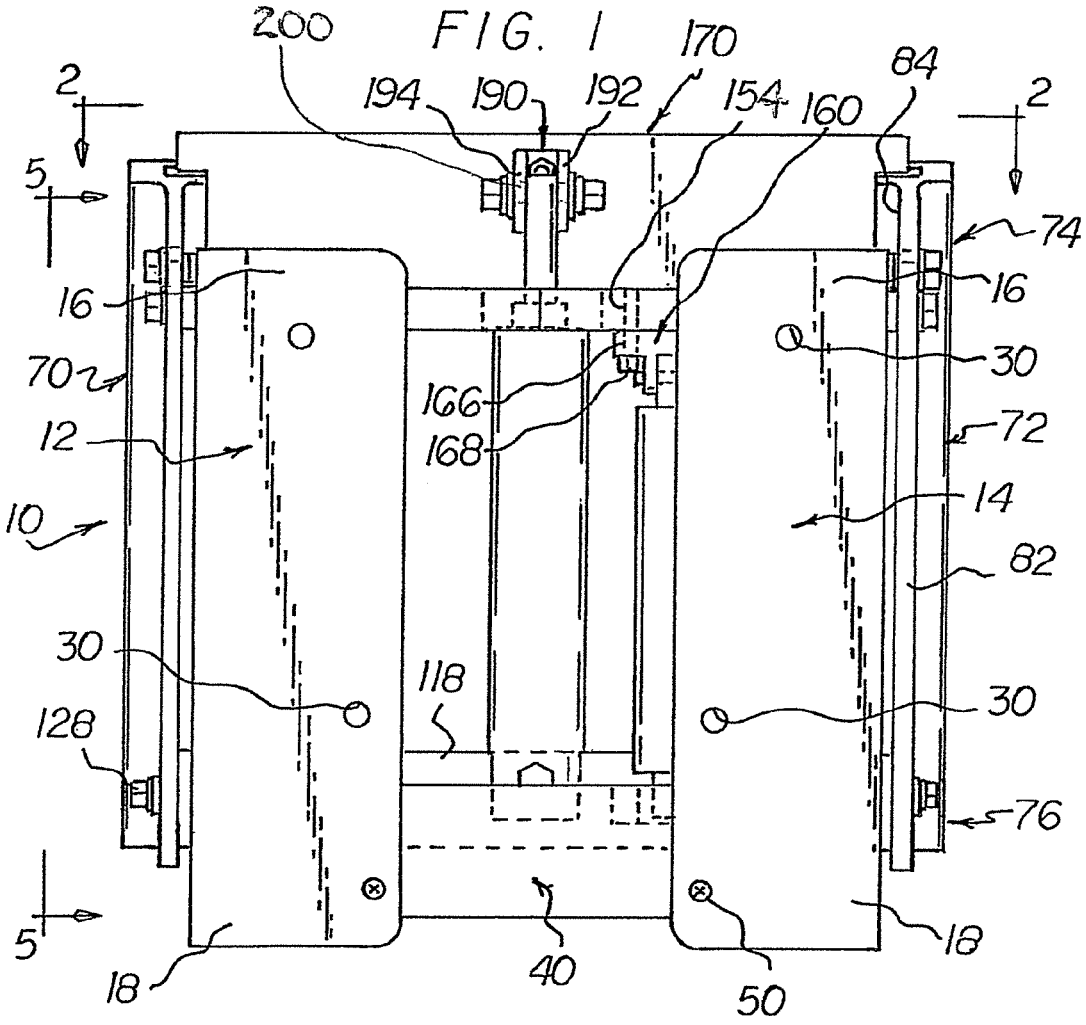
FIG. 1 is an elevational view from the front of the jack plate, where the jack plate attaches to a boat transom.
Figure 2:
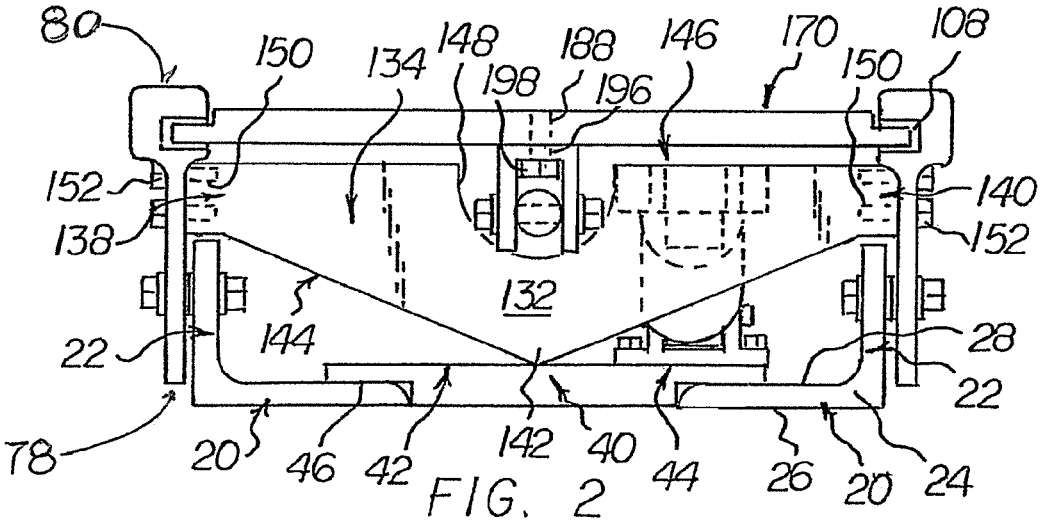
FIG. 2 is a view taken along line 2-2 of FIG. 1.
Figure 5:
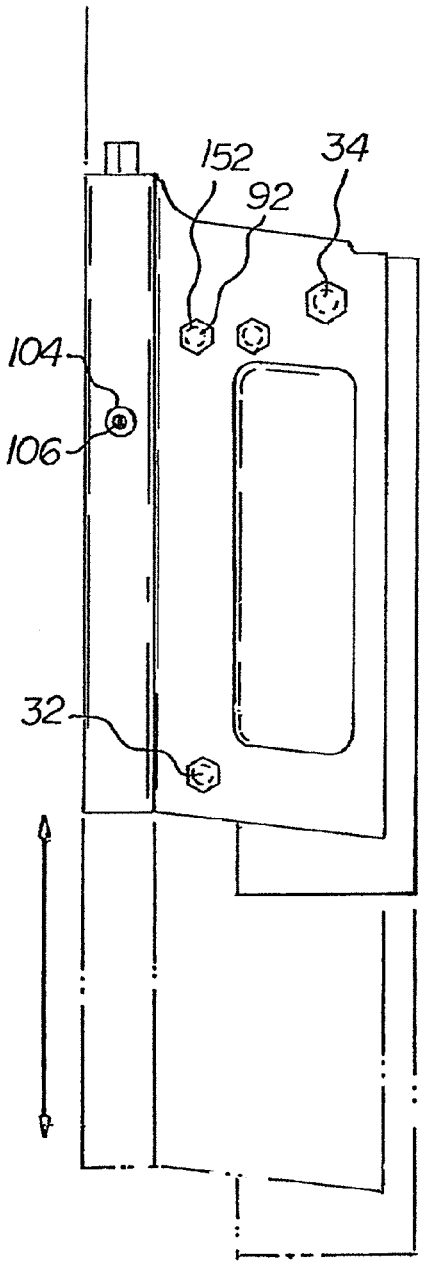
FIG. 5 is a view taken along line 5-5 of FIG. 1, showing the slide plate in the down position.

With reference now to the drawings, and in particular to FIG. 1 thereof, the preferred embodiment of the new and improved tilt and lift jack plate embodying the principles and concepts of the present invention and generally designated by the reference numeral 10 will be described.

The present invention, the tilt and lift jack plate 10 is comprised of a plurality of components. Such components in their broadest context include a pair of transom mounting brackets, a pair of slide plate holders, a slide plate and a plurality of hydraulic cylinders. Such components are individually configured and correlated with respect to each other so as to attain the desired objective.

There is now described a tilt and lift jack plate 10, comprising several components, in combination.

First, there is a pair of mirror image transom mounting brackets, being a right transom mounting bracket 12 and a left transom mounting bracket 14. Each transom mounting bracket has an upper end 16 and a lower end 18. Each transom mounting bracket has a forward leg 20 configured to be attached to a boat transom, and a rearward directed leg 22. The forward leg and the rearward leg each are oriented at right angles to each other. The forward leg has a first length, and the rearward leg has a second length. The first length is greater than the second length. The forward leg has a thickness 24, with a forward surface 26 and a rearward surface 28. The forward leg has a plurality of transom mounting bolt apertures 30 there through. Each forward leg, of the transom mounting bracket, has a lower cross member mounting bolt hole 32 therethrough. Each rearward leg of each transom mounting bracket has a pivot point aperture 34 located near the upper end of each transom mounting bracket.

Next, there is a lower transom mounting bracket cross member 40. The lower transom mounting bracket cross member has a generally rectilinear configuration, with a right end portion 42 and a left end portion 44. The right end portion and the left end portion each have a stepped configuration, forming a recess 46 therein.

Each lower transom mounting bracket cross member recess has a lower transom mounting bracket cross member threaded bolt hole 48 therein. Each lower transom mounting bracket cross member threaded bolt hole has an associated lower transom mounting bracket cross member bolt 50.

The lower transom mounting bracket cross member bolt is used to couple the lower transom mounting bracket cross member with each of the forward legs of the transom mounting brackets. The left end portion of the lower transom mounting bracket cross member has a pair of threaded tilting hydraulic cylinder case bracket mounting bolt holes 52 therein.

Next, there is a tilting hydraulic cylinder case bracket 54. The tilting hydraulic cylinder case bracket has a lower transom cross member portion 56, and a pair of rearwardly oriented tabs 58. The lower transom cross member portion has a pair of mounting bolt holes 60 therethrough, with a pair of associated tilting hydraulic cylinder case bracket mounting bolts 62, for coupling the tilting hydraulic cylinder case bracket to the lower transom mounting bracket cross member.

Next there is a pair of slide plate holders being a right slide plate holder 70 and a left slide plate holder 72. The slide plate holders each are mirror images of the other. Each slide plate holder has an upper end 74, a lower end 76, a forward surface 78, a rearward surface 80, an outward surface 82, and an inward surface 84. Each slide plate holder has a forward portion 86. Each slide plate holder has a rearward portion 88. The forward portion of each slide plate holder has a generally rectilinear configuration, with each slide plate holder forward portion having a pivot point bolt hole 90 therethrough.

The forward portion of each slide plate holder has a pair of upper slide plate holder cross member mounting bolt holes 92 therethrough. The forward portion of each slide plate holder has a slide plate holder lower cross member mounting bolt hole 94 therethrough. The forward portion of each slide plate holder has an associated pivot point bolt 96, with the pivot point bolt rotatably coupling the forward portion of each slide plate holder to the transom mounting bracket.

The rearward portion of each slide plate holder has a generally C-shaped configuration 98, with an inward surface 100. There is with a slide plate groove 102 located in the inward surface of each rearward portion of each slide plate holder. The rearward portion of each slide plate holder has a threaded grease fitting aperture 104, with a grease fitting 106 being threadly coupled thereto. Each grease fitting aperture is in communication with the slide plate groove. Each slide plate holder rearward portion groove has a groove insert 108 located therein.

Next, there is a slide plate holder lower cross member 110. The slide plate holder lower cross member has a generally rectilinear configuration, with a right end 112, a left end 114, and a central portion 116. The slide plate holder lower cross member also has a forward surface 118, a rearward surface 120, a top surface 122, and a bottom surface 124. The right end of the slide plate holder lower cross member and the left end of the slide plate holder lower cross member each have a threaded aperture 126 therein. The slide plate holder lower cross member has an associated bolt 128, with the associated bolt of the slide plate holder lower cross member fixedly coupling each slide plate holder to each other slide plate holder by the bolt passing through the slide plate holder lower cross member mounting bolt hole and into the threads of the threaded aperture of the slide plate holder lower cross member. The central portion of the slide plate holder lower cross member has a lifting hydraulic ram mounting bolt hole 130 there through.

Next, there is an upper slide plate holder cross member 132 having an upper surface 134, a lower surface 136, a right end 138, and a left end 140 with a center 142, therebetween. The upper slide plate holder cross member also has a forward surface 144 and a rearward surface 146. The upper slide plate cross member forward surface has a generally V-shaped configuration.

The upper slide plate cross member rearward surface is a generally flat surface, with a hemispherical recess 148 therein. The hemispherical recess is centrally located on the rearward surface of the upper slide plate cross member. The upper slide plate cross member right end and the upper slide plate cross member left end each have a pair of threaded bolt holes 150 therein. The upper slide plate cross member threaded bolt holes each have an associated bolt 152. The upper slide plate cross member bolt fixedly couples the upper slide plate cross member to the right slide plate holder and to the left slide plate holder. The lower surface of the upper slide plate holder cross member has a pair of threaded tilting hydraulic cylinder ram mounting bracket bolt holes 154 located to one side of the center of the upper slide plate holder cross member.

Next, there is a tilting hydraulic cylinder ram mounting bracket 160 having an upper slide plate holder cross member portion 162 and a pair of downwardly oriented tabs 164. The upper slide plate holder cross member portion of the tilting hydraulic cylinder ram mounting bracket has a pair of mounting bolt holes 166 there through. There is a pair of associated tilting hydraulic cylinder ram bracket mounting bolts 168, for coupling the tilting hydraulic cylinder ram bracket to the lower surface of the upper slide plate holder cross member.

Next, there is a slide plate 170. The slide plate has a generally rectilinear configuration, with a rearward surface 172 and a forward surface 174. The slide plate also has an upper surface 176, a lower surface 178, a right side portion 180 and a left side portion 182. The slide plate as a central portion 184 which is between the left side portion of the slide plate and the right side portion of the slide plate.

The slide plate has a plurality of motor mounting bolt holes 186 therethrough. The slide plate has a pair of lifting ram bracket mounting bolt holes 188 therethrough. The lifting ram bracket mounting bolt holes are generally centrally located near the upper surface of the slide plate. By generally centrally located is meant that the holes are located generally between the right side portion and the left side portion, in the central portion of the slide plate.

Next, there is a lifting hydraulic cylinder ram bracket 190. The lifting hydraulic cylinder ram bracket has a generally C-shaped configuration. The lifting hydraulic cylinder ram bracket has a rearward mounting portion 192 and a pair of forward oriented tabs 194. The rearward mounting portion of the lifting ram bracket has a pair of rearward mounting portion bolt holes 196 therethrough. The rearward mounting bolt holes have a pair of associated rearward mounting portion bolts 198. The rearward mounting portion bolts are used to fixedly couple the lifting ram bracket to the central portion of the slide plate. The forward oriented tabs of the lifting ram bracket each have a lifting hydraulic ram pin hole 200 therethrough.

Next, there is a lifting hydraulic cylinder 210 having a lifting hydraulic ram 212 and a lower case 214. The lower case of the lifting hydraulic cylinder is fixedly coupled to the slide plate holder lower cross member. The lower case of the lifting hydraulic cylinder has a plurality of fluid passageways 216 therethrough. The lifting hydraulic cylinder ram has a distal end 218. The distal end of the lifting hydraulic cylinder ram has a pin hole 220 therethrough. There is an associated lifting hydraulic cylinder ram pin 222. The lifting hydraulic cylinder ram pin rotatably couples the lifting hydraulic ram with the lifting hydraulic cylinder ram bracket. The lifting hydraulic cylinder ram pin passes through the forward oriented tabs of the lifting ram bracket and through the lifting hydraulic cylinder ram pin hole.

Next, there is a tilting hydraulic cylinder 230. The tilting hydraulic cylinder has a tilting hydraulic ram 232 and a lower case 234. The lower case of the tilting hydraulic cylinder being fixedly coupled to the tilting hydraulic cylinder case bracket of the lower transom mounting bracket cross member.

The lower case of the tilting hydraulic cylinder has a plurality of fluid passageways 236 therethrough. The tilting hydraulic cylinder ram has a distal end 238. The distal end of the tilting hydraulic cylinder ram has a pin hole 240 therethrough. The tilting hydraulic cylinder has an associated ram pin 242. The tilting hydraulic cylinder ram pin rotatably couples the tilting hydraulic ram with the tilting hydraulic cylinder ram mounting bracket.

Next, there is a plurality of hydraulic fluid lines 250. The hydraulic fluid lines are operatively coupled to each of the fluid passageways of the tilting hydraulic cylinder and the lifting hydraulic cylinder.

Next, there is a hydraulic pump 260 having a reservoir 262 of hydraulic fluid.

Next, there is a control valve body 270. The control valve body is coupled to the hydraulic pump, the lifting hydraulic cylinder, and the tilting hydraulic cylinder. The control valve body controls the hydraulic fluid flow to the lifting hydraulic cylinder and the tilting hydraulic cylinder. The control valve body has an actuator means 272. An actuator means includes such control means as levers, buttons, and switches.

Lastly, there is a power source 280. The power source use used to provide power to the hydraulic pump. The power source is operatively coupled to the hydraulic pump. In the preferred embodiment, the power source is a battery.

The hydraulic fluid lines couple the hydraulic pump to the control valve and the control valve to the lifting hydraulic cylinder and the tilting hydraulic cylinder. This configuration allows the fluid to move from the reservoir, through the pump, through the control valve, to the hydraulic cylinders, and back through the control valve, and back to the reservoir.

Figure 6:
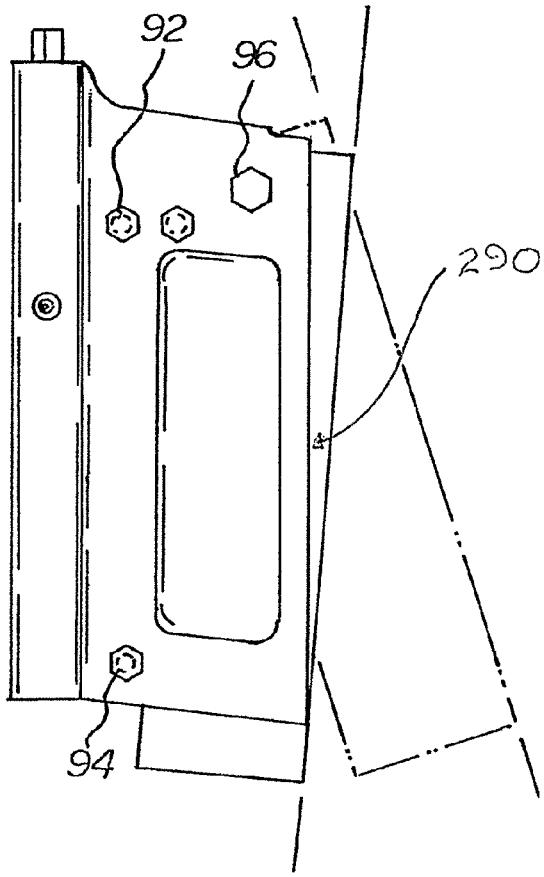
FIG. 6 is a side elevational view showing the angle between the transom mounting brackets and the slide plate holders.
Figure 7:
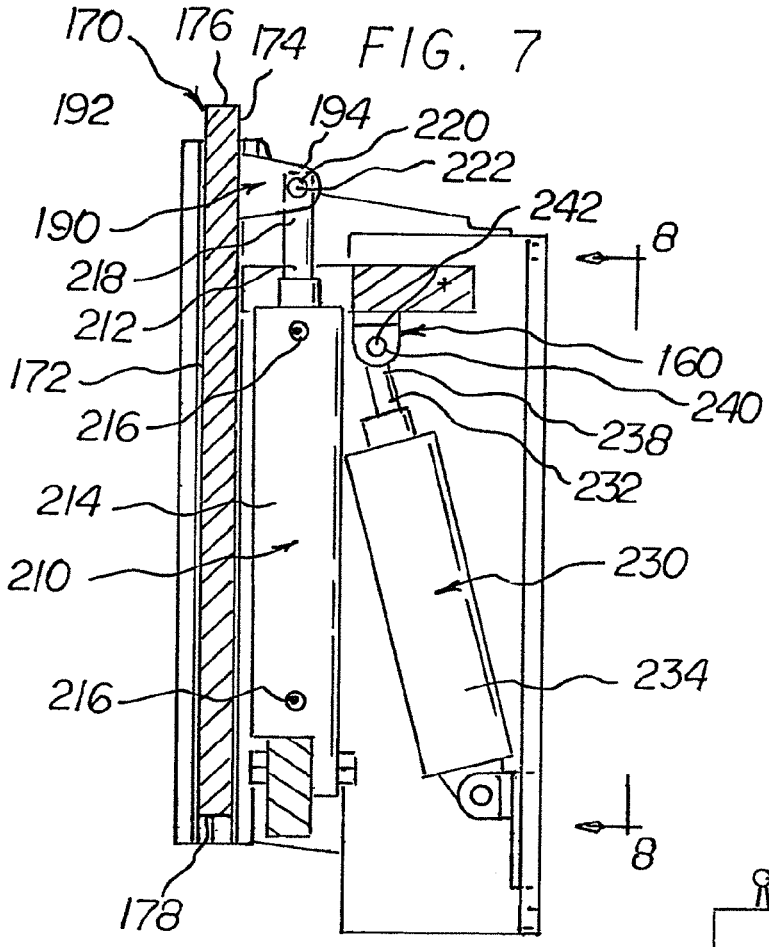
FIG. 7 is a cross sectional view showing the lifting cylinder and the tilting cylinder relative to each other.
Figure 8:
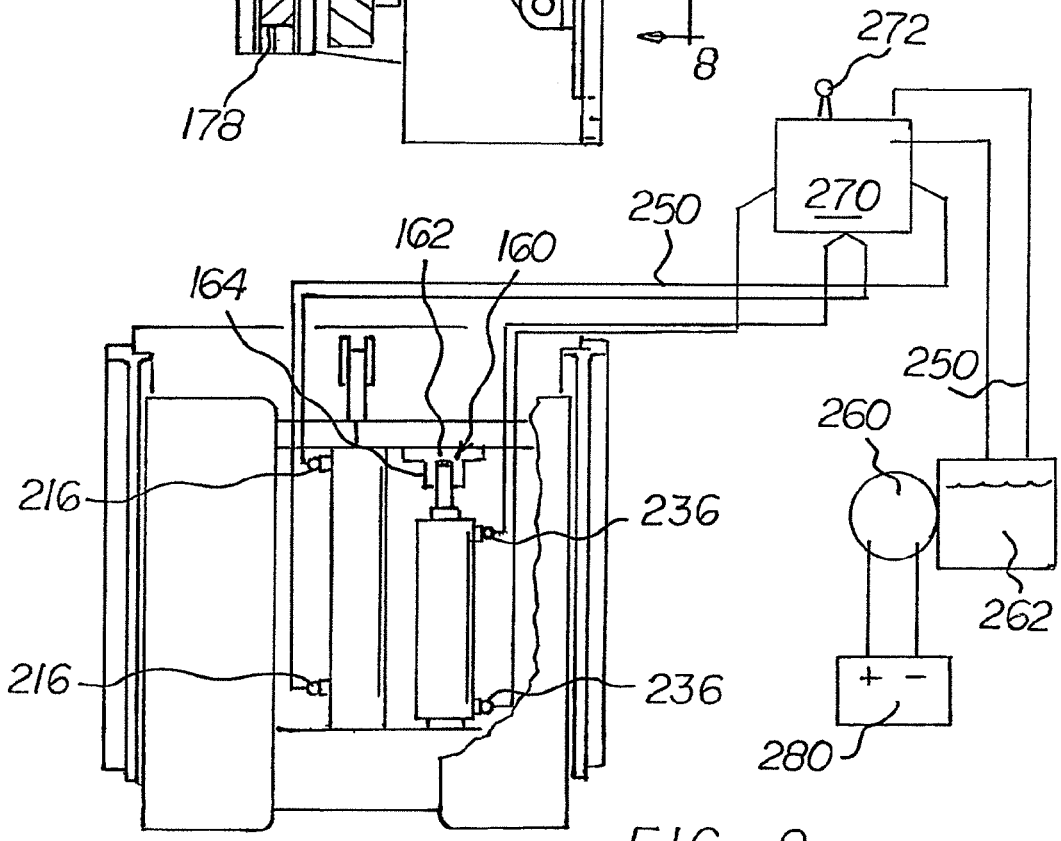
FIG. 8 is a view showing the jack plate in an operative relation with the hydraulic pump, hydraulic lines and control valve.

It should be noted that there is an angle 290 of between about four degrees and fifteen degrees formed by the transom mounting brackets and slide plate holders, as shown in FIG. 6 when the bracket is in the "tucked position". By "tucked position" is meant that the jack plate tilting cylinder ram is fully retracted into the tilting cylinder case causing the tilting action of the jack plate to be at the minimum. In other words, the tilt is at a minimum. This "tucking" angulation of the slide plate holders relative to the transom mounting brackets, and the boat transom, allows the motor to be angled "under" the boat transom. This angulation allows the motor to assist in lifting the boat hull during forward movement, and assists the boat in getting "on plane", as is accomplished by "lift tabs", which are commonly known in the boating industry, and to boat owners. While most transoms have some angulation, allowing the tuck of a motor, this configuration, in that instance, allows even greater motor "tuck", which is more than the manufacturer provides in the structure of the boat hull.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tilt and lift jack plate, comprising, in combination:

a pair of transom mounting brackets being a right transom mounting bracket and a left transom mounting bracket, with each transom mounting bracket having an upper end and a lower end, a tilting hydraulic cylinder case bracket being coupled to each of the transom mounting brackets;

a pair of slide plate holders being a right slide plate holder and a left slide plate holder, each slide plate holder being coupled to each of the transom mounting brackets;

a slide plate slidably coupled to each of the slide plate holders;

a tilting hydraulic cylinder ram mounting bracket being coupled to the slide plate;

a lifting hydraulic cylinder ram bracket being coupled to the slide plate;

a lifting hydraulic cylinder having a lifting hydraulic ram with the lifting hydraulic cylinder ram being coupled to the lifting hydraulic cylinder ram bracket and a lower case with the lower case of the lifting hydraulic cylinder being coupled to the pair of slide plate holders; and a tilting hydraulic cylinder having a tilting hydraulic ram with the tilting hydraulic cylinder ram being coupled to the tilting hydraulic cylinder ram bracket and a lower case with the lower case of the tilting hydraulic cylinder being coupled to the pair of transom mounting brackets.

2. The tilt and lift jack plate as described in claim 1, with the tilt and lift jack plate further comprising:

the transom mounting brackets being mirror images of each other;

a transom mounting bracket cross member having a right end portion and a left end portion;

the tilting hydraulic cylinder case bracket having a lower transom cross member portion and a pair of rearwardly oriented tabs;

a slide plate holder lower cross member having a right end and a left end and a central portion and a forward surface and a rearward surface and a top surface and a bottom surface, the slide plate holder lower cross member coupling the slide plate holders to each other; and an upper slide plate holder cross member having an upper surface and a lower surface and a right end and a left end and a center therebetween and a forward surface and a rearward surface, the upper slide plate holder cross member coupling the slide plate holders to each other.

3. The tilt and lift jack plate as described in claim 2, with the tilt and lift jack plate further comprising:

a lower transom mounting bracket cross member coupling the pair of transom mounting brackets;

each transom mounting bracket having a forward leg configured to be attached to a boat transom and a rearward directed leg, the forward leg and the rearward leg each being oriented at right angles to each other, the forward leg having a first length and the rearward leg having a second length;

each of the transom mounting brackets right end portion and each of the transom mounting brackets left end portion each having a stepped configuration forming a recess;

each slide plate holder having an upper end and a lower end and a forward surface and a rearward surface and a outward surface and an inward surface, with each slide plate holder having a forward portion and each slide plate holder having a rearward portion;

the right end and the left end of the upper slide plate cross member each having a pair of threaded bolt holes therein, with the threaded bolt holes each having an associated bolt;

the slide plate having a rearward surface and a forward surface and an upper surface and a lower surface and a right side portion and a left side portion with a central portion between the right side portion and the left side portion, the slide plate having a plurality of motor mounting bolt holes therethrough; and the lower case of the lifting hydraulic cylinder being coupled to the slide plate holder lower cross member, the lower case of the lifting hydraulic cylinder having a plurality of fluid passageways therethrough.

4. The tilt and lift jack plate as described in claim 3, with the tilt and lift jack plate further comprising:

the forward leg first length of each transom mounting bracket being greater than the rearward leg second length of each transom mounting bracket, the forward leg having a thickness with a forward surface and a rearward surface;

each lower transom mounting bracket cross member recess having a lower transom mounting bracket cross member threaded bolt hole therein, with each lower transom mounting bracket cross member threaded bolt hole having an associated lower transom mounting bracket cross member bolt;

each slide plate holder forward portion having a pivot point bolt hole therethrough, with the forward portion of each slide plate holder having a pair of upper slide plate holder cross member mounting bolt holes therethrough;

the right end and the left end of the slide plate holder lower cross member each having a threaded aperture therein;

the upper slide plate cross member bolt fixedly coupling the upper slide plate cross member to the right slide plate holder and to the left slide plate holder;

the slide plate having a pair of lifting ram bracket mounting bolt holes therethrough; and the lower case of the tilting hydraulic cylinder being coupled to the tilting hydraulic cylinder case bracket of the lower transom mounting bracket cross member, the lower case of the tilting hydraulic cylinder having a plurality of fluid passageways therethrough.

5. The tilt and lift jack plate as described in claim 4, with the tilt and lift jack plate further comprising:

the forward leg of each transom mounting bracket having a plurality of transom mounting bolt apertures there through;

the lower transom mounting bracket cross member bolt being used to couple the lower transom mounting bracket cross member with each of the forward legs of the transom mounting brackets;

the slide plate holder lower cross member having an associated bolt with the associated bolt of the slide plate holder lower cross member fixedly coupling each slide plate holder to each other by the bolt passing through the slide plate holder lower cross member mounting bolt hole and into the threads of the threaded aperture of the slide plate holder lower cross member;

the lower surface of the upper slide plate holder cross member having a pair of threaded tilting hydraulic cylinder ram mounting bracket bolt holes located off of the center of the upper slide plate holder cross member;

the tilting hydraulic cylinder ram mounting bracket having an upper slide plate holder cross member portion and a pair of downwardly oriented tabs;

the lifting ram bracket having a rearward mounting portion and a pair of forward oriented tabs; and the lifting hydraulic cylinder ram having a distal end, with the distal end of the lifting hydraulic cylinder ram having a pin hole there through with an associated ram pin with the lifting hydraulic cylinder ram pin.

6. The tilt and lift jack plate as described in claim 5, with the tilt and lift jack plate further comprising:

each transom mounting bracket forward leg having a lower cross member mounting bolt hole therethrough;

the left end portion of the lower transom mounting bracket cross member having a pair of threaded tilting hydraulic cylinder case bracket mounting bolt holes therein;

the forward portion of each slide plate holder having an associated pivot point bolt with the pivot point bolt rotatably coupling the forward portion of each slide plate holder to the transom mounting bracket;

the upper slide plate holder cross member portion having a pair of mounting bolt holes there through with a pair of associated tilting hydraulic cylinder ram bracket mounting bolts for coupling the tilting hydraulic cylinder ram bracket to the lower surface of the upper slide plate holder cross member;

the lifting ram bracket rearward mounting portion having a pair of mounting bolt holes there through, with the rearward mounting bolt holes having a pair of associated rearward mounting portion bolts;

the lifting hydraulic cylinder ram pin rotatably coupling the lifting hydraulic ram with the lifting hydraulic cylinder ram bracket;

the tilting hydraulic cylinder ram having a distal end;

a hydraulic pump having a reservoir of hydraulic fluid, the hydraulic pump operatively coupled to the lifting hydraulic cylinder and the tilting hydraulic cylinder;

a control valve body coupled to the hydraulic pump and the lifting hydraulic cylinder and the tilting hydraulic cylinder;

a power source to provide power to the hydraulic pump, the power source being operatively coupled to the hydraulic pump; and a plurality of hydraulic fluid lines with a hydraulic fluid line being operatively coupled to each of the fluid passageways of the tilting hydraulic cylinder and the lifting hydraulic cylinder.

7. The tilt and lift jack plate as described in claim 6, with the tilt and lift jack plate further comprising:

each rearward leg of each transom mounting bracket having a pivot point aperture located near the upper end of each transom mounting bracket;

the lower transom cross member portion having a pair of mounting bolt holes there through with a pair of associated tilting hydraulic cylinder case bracket mounting bolts for coupling the tilting hydraulic cylinder case bracket to the lower transom mounting bracket cross member;

the rearward portion of each slide plate holder having a generally C-shaped configuration with a slide plate groove being located in the inward surface of each rearward portion of each slide plate holder;

the central portion of the slide plate holder lower cross member having a lifting hydraulic ram mounting bolt hole there through;

the lifting ram bracket rearward mounting portion bolts fixedly coupling the lifting ram bracket to the central portion of the slide plate, the forward oriented tabs of the lifting ram bracket each having a lifting hydraulic ram pin hole therethrough; and the control valve body controlling the hydraulic fluid flow to the lifting hydraulic cylinder and the tilting hydraulic cylinder.

8. The tilt and lift jack plate as described in claim 7, with the tilt and lift jack plate further comprising:

the rearward portion of each slide plate holder having a treaded grease fitting aperture with a grease fitting threadly coupled thereto, with each grease fitting aperture in communication with the slide plate groove; and the upper slide plate cross member rearward surface being a generally flat surface with a hemispherical recess therein.

9. The tilt and lift jack plate as described in claim 8, with the tilt and lift jack plate further comprising:

the forward portion of each slide plate holder having a generally rectilinear configuration;

each slide plate holder rearward portion groove having a groove insert located therein;

with the hemispherical recess being centrally located on the rearward surface of the upper slide plate cross member;

the slide plate lifting ram bracket mounting bolt holes being centrally located near the upper surface of the slide plate;

the distal end of the tilting hydraulic cylinder ram having a pin hole there through with an associated ram pin with the tilting hydraulic cylinder ram pin rotatably coupling the tilting hydraulic ram with the tilting hydraulic cylinder ram mounting bracket; and the control valve body having an actuator means.

10. The tilt and lift jack plate as described in claim 9, with the tilt and lift jack plate further comprising:

the transom mounting bracket cross member having a generally rectilinear configuration;

the slide plate holders each being mirror images of each other;

the slide plate holder lower cross member having a generally rectilinear configuration;

the upper slide plate cross member forward surface having a generally V-shaped configuration;

the slide plate having a generally rectilinear configuration; and the lifting ram bracket having a generally C-shaped configuration.

11. A tilt and lift jack plate, comprising, in combination:

a pair of transom mounting brackets;

a pair of slide plate holders being coupled to each of the transom mounting brackets;

the transom mounting brackets and the slide plate holders being oriented angled to each other when the jack plate is in a tucked position, with the angle between the slide plate holders and the transom mounting brackets in the tucked position being between about four degrees and fifteen degrees;

a slide plate slidably coupled to each of the slide plate holders;

a tilting hydraulic cylinder being coupled to the slide plate; and a hydraulic pump, operatively coupled to the tilting hydraulic cylinder.

12. The tilt and lift jack plate as described in claim 11, with the tilt and lift jack plate further comprising:

a lifting hydraulic cylinder being coupled to the slide plate;

an upper slide plate holder cross member coupling the slide plate holders, with the tilting hydraulic cylinder being coupled to the upper slide plate holder.

13. The tilt and lift jack plate as described in claim 12, with the tilt and lift jack plate further comprising:

a hydraulic pump having a reservoir of hydraulic fluid, the hydraulic pump operatively coupled to the lifting hydraulic cylinder and the tilting hydraulic cylinder;

a control valve body coupled to the hydraulic pump and the lifting hydraulic cylinder and the tilting hydraulic cylinder;

a power source to provide power to the hydraulic pump, the power source being operatively coupled to the hydraulic pump; and a plurality of hydraulic fluid lines with a hydraulic fluid line being operatively coupled to each of the fluid passageways of the tilting hydraulic cylinder and the lifting hydraulic cylinder.

* * * * *